United States Patent [19]

Hynes

[11] Patent Number: 4,778,170

[45] Date of Patent: Oct. 18, 1988

[54] COPY SHEET TRAY WITH ADJUSTABLE BACK STOP AND SCUFFER MECHANISM

[75] Inventor: Frank R. Hynes, Rochester, N.Y.

[73] Assignee: Xerox Corporation, Stamford, Conn.

[21] Appl. No.: 443,800

[22] Filed: Nov. 22, 1982

[51] Int. Cl.[4] ..... B65H 9/04

[52] U.S. Cl. ..... 271/253; 271/171; 271/230; 271/224

[58] Field of Search ..... 271/3.1, 171, 229, 230, 271/248, 250, 253, 254, 255, 223, 224; 355/3 SH

[56] References Cited

U.S. PATENT DOCUMENTS

| | | | |
|---|---|---|---|
| 3,592,464 | 7/1971 | Kanda | 271/223 |
| 3,645,615 | 2/1972 | Spear, Jr. | 355/3 |
| 4,097,042 | 6/1978 | Rozga | 271/224 |
| 4,219,191 | 8/1980 | Rastorguyeff | 271/3.1 |
| 4,248,413 | 2/1981 | Fox | 271/236 |
| 4,330,197 | 5/1982 | Smith et al. | 271/3.1 |
| 4,365,886 | 12/1982 | Murakami et al. | 271/3.1 |

FOREIGN PATENT DOCUMENTS

| | | | |
|---|---|---|---|
| 1481466 | 7/1977 | United Kingdom . | |
| 2024170 | 1/1980 | United Kingdom | 271/3.1 |
| 1598604 | 9/1981 | United Kingdom . | |
| 2089771 | 6/1982 | United Kingdom . | |

OTHER PUBLICATIONS

IBM Tech. Disc. Bull. *Collator Impact Bar,* Lamos et al., vol. 18, No. 3, Aug. 1975, p. 617.

Xerox Disc. Jour., *System for Auto Adj. Side Guides,* Collins, vol. 1, Nos. 9/10, Sep./Oct. 1976, p. 41.

*Primary Examiner*—Joseph J. Rolla

[57] ABSTRACT

A scuffer/back stop mechanism for a duplex copy sheet tray is disclosed as having a carriage mechanism supporting two rotating members which serve as stops for the sheets entering the tray. The members are rotated to drive the sheets against side registration elements thereby effecting corner registration. The carriage is arranged to be driven to move the stop members in accordance with a parameter of the copy sheets sensed at the supply source for the sheets.

5 Claims, 4 Drawing Sheets

COPY SHEET TRAY WITH ADJUSTABLE BACK STOP AND SCUFFER MECHANISM

This invention relates to an improvement in copy sheet duplex tray apparatus for use in a reproduction machine or copier, and more particularly to a system for automatically adjusting a duplex tray scuffer mechanism having a back stop in response to the size of the copy sheets being processed.

Modern day high speed reproduction machines or copiers enable the operator to perform a variety of different copy functions such as simplex copying, duplex copying, sorting, collating, stapling, and the like. However, the addition of these various features often comes at the expense of additional burdens on the user or operator in the form of machine set ups and adjustments that are required before the feature can be implemented. To compound the burdens has been the strategy to devise a machine international in nature, that is, a machine which may utilize various copy sheet sizes indigenous to the various countries of the world. For example, in the United States, the current copy size is 8½ inches×11 inches, whereas throughout the world the international sizes B4, B5 and A4 are standard sizes. The goal, to enable a machine to accommodate a multitude of sheet sizes such as exemplified above, has in some cases led to the imposition on the user or operator of certain manual tasks that must be performed before the machine may be used. In some cases, this requirement may not only be burdensome and time consuming but may also, because of the nature of the machine, be difficult, as for example, where the part to be adjusted is not easily accessible.

Therefore, it is the principle object of the present invention to simplify duplex operation of a copier by conditioning the duplex tray utilized in this mode of operation automatically to accommodate copy sheets of various sizes and in accordance therewith.

The invention is directed to a duplex tray for a copier which is capable of producing duplex or two sided copying, wherein the tray is arranged to receive copy sheets having a first side copied thereon and before these copy sheets are redirected into the copier processor to receive a second image on their second sides. In accordance with the invention, a scuffer assembly is arranged in cooperation with the duplex tray and includes rotary engaging rollers which drive the sheets into edge registration thereby effecting corner registration of the sheets as they become deposited into the tray. The scuffer assembly is movable in for the aft of the tray in order to accommodate sheets of many different widths and such movement is under control of means for sensing the width of copy sheets before entering the tray.

Other objects and advantages of the invention will become apparent after reading the description taken in conjunction with the accompanying drawings wherein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
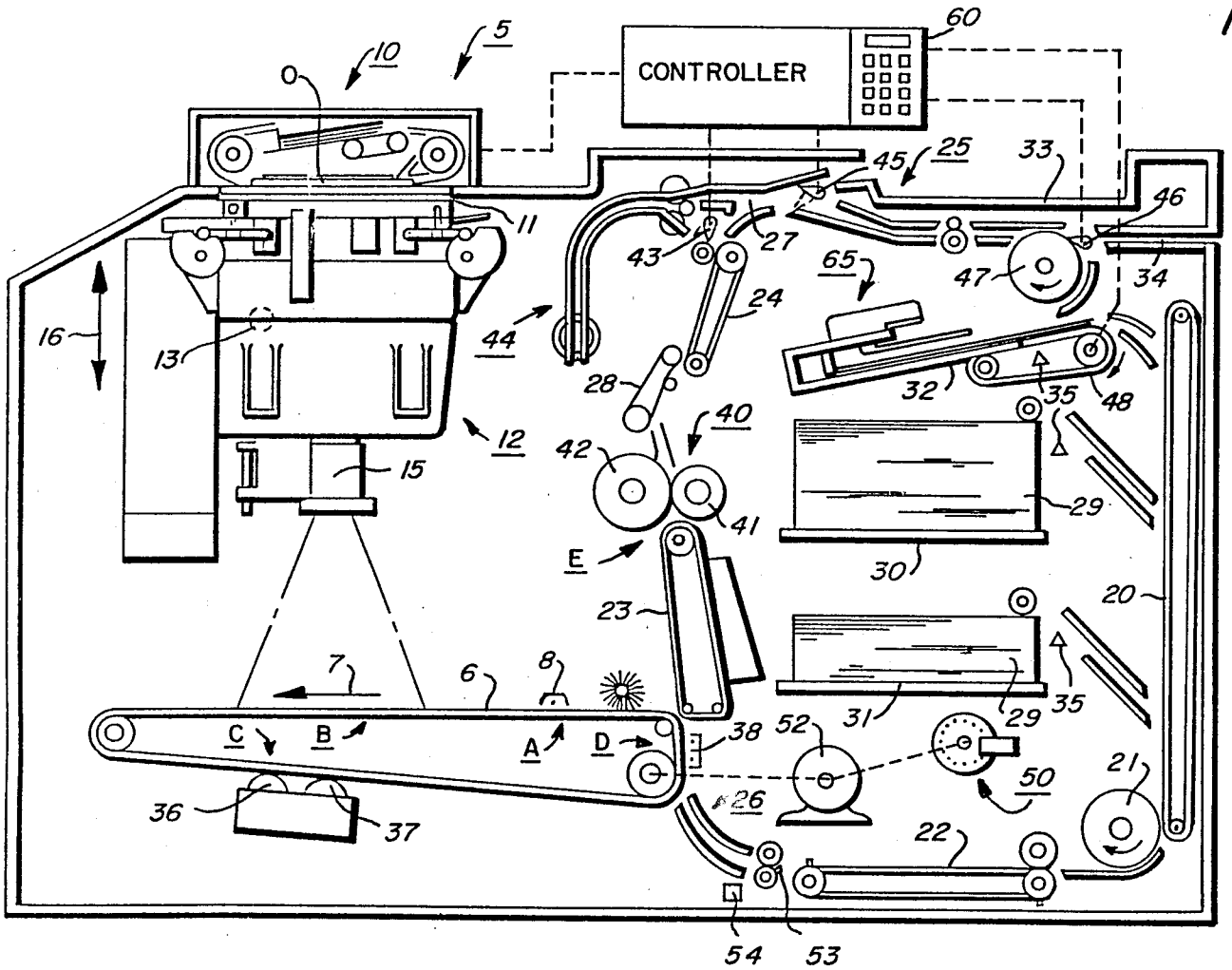
FIG. 1 is a schematic view of a reproduction machine or copier incorporating the automatic duplex tray sizing system of the present invention.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the copy processing and jam monitoring system of the present invention therein. It will become evident from the following discussion that the invention is equally well suited for use in a wide variety of printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine 5 employs a belt 6 having a photoconductive surface thereon. Preferably, the photoconductive surface is made from a selenium alloy. Belt 6 moves in the direction indicated by the arrow 7 to advance successive portions of the photoconductive surface through the various processing stations disposed about the path of movement thereof. Successive portions of the photoconductive surface pass through charging station A whereat a corona generating device, indicated generally by the reference numeral 8, charges the photoconductive surface to a relatively high substantially uniform potential.

A charged portion of the photoconductive surface is advanced through imaging station B whereat it is exposed to imaging light rays of a document O handled in a document handling unit, indicated generally by the reference numeral 10. The unit 10 positions original documents O facedown on a transparent platen 11. An exposure system, indicated generally by reference numeral 12, includes lamp 13 which illuminates each document O positioned on platen 11 and the light rays reflected from the document O are transmitted through a lens system 15. The lens system 15 focuses the light image of the document O onto the charged portion of the photoconductive surface of the belt 6 to selectively dissipate the charge thereof in image configuration. This records an electrostatic latent image on the photoconductive surface which corresponds to the informational areas contained within the original document.

Thereafter, the belt 6 advances the electrostatic latent image recorded on the photoconductive surface to development station C. The platen 11 is movably mounted and arranged to move in the direction of arrows 16 to adjust the magnification of the original document being reproduced. The lens system 15 moves in synchronism therewith so as to focus the imaging light rays of original document O onto the charged portion of the photoconductive surface of the belt 6.

Document handling unit 10 sequentially feeds document sheets from a stack placed by the operator in a normally forward collated order in a document stacking and holding tray. The document sheets are fed in seriatim from the holding tray to platen 11. The document handling unit recirculates document sheets back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured. Preferably, magnification of the imaging system is adjustable to insure that information contained on the original document is reproduced within the space of the copy sheet.

A plurality of sheet transports 20, 21, 22, 23, 24, 25, sheet guides 26 and 27 and decurler 28 cooperate to form a paper path along which the copy sheets being processed pass from either main paper supply tray 30, or auxiliary paper supply tray 31, or duplex paper supply tray 32 through the machine 5 to either output tray 33 or discharge path 34. Transports 20, 21, 22, 23, 24, may be driven by a common motor (not shown) with specific gear drives or be provided with their own individual drive system under coordinated action. Suitable sheet sensors designated here by the numeral 35, are provided at the output of each paper tray 30, 31 and duplex tray 32 to detect feeding of a sheet therefrom and sheet monitoring.

With continued reference to FIG. 1, at development station C, a pair of magnetic brush developer rollers, indicated generally by the reference numerals 36 and 37, advance developer material into contact with the electrostatic latent image. The latent image attracts toner particles from the carrier granules of the developer material to form a toner powder image on the photoconductive surface of belt 6.

After the electrostatic latent image recorded on the photoconductive surface of the belt is developed, belt 6 advances the toner powder image to transfer station D whereat a copy sheet is moved into transfer relation with the toner powder image. The transfer station D includes a corona generating device 38 which sprays ions onto the backside of the copy sheet, thus attracting the toner powder image from the photoconductive surface of the belt 6 to the sheet. After transfer, the pre-fuser transport 23 advances the sheet to the fusing station E.

The fusing station E includes a fuser assembly, indicated generally by the reference numeral 40, which permanently affixes the transferred powder image to the copy sheet. Preferably, the fuser assembly 40 includes a heated fuser roller 41 and backup roller 42. The sheet passes between the fuser roller and the backup roller with the powder image contacting fuser roller 42. In this manner, the powder image is permanently affixed to the sheet.

After fusing, the decurler 28 transports the sheets to the transport 24 which directs the same to a gate 43 which functions as an inverter selector. Depending upon the position of gate 43, the copy sheets will either be deflected into a sheet inverter 44 or bypass the sheet inverter and be fed directly to a second decision gate 45. Thus, copy sheets which bypass the inverter 44 are turned 90° in the sheet path before reaching the gate 45 which directs the sheets into a faceup orientation so that the imaged side, which has been transferred and fused, is faceup. If inverter path 44 is selected, the opposite is true, i.e. the last printed face is facedown. The second decision gate 45 deflects the sheet directly into the output tray 33 or deflects the sheet into a transport path which carries the sheet to a third decision gate 46. The gate 46 either passes the sheets directly on without inversion to the discharge path 34 or routes the sheets into a duplex inverter roll transport 47.

The transport 47 inverts and stacks the sheets to be duplexed in the duplex tray 32 when gate 46 so directs. The duplex tray 32 provides intermediate or buffer storage for those sheets which have been printed on one side and on which an image will be subsequently printed on the side opposed thereto, i.e. the copy sheets being duplexed. Due to the sheet inverting action of transport 47, the buffer set sheets are stacked in the duplex tray 32 facedown in the order in which the sheets have been copied.

In order to complete duplex copying, the previously simplexed sheets in the tray 32 are fed seriatim by a bottom feeder 48 back to the transfer station D for transfer of the toner powder image to the opposed side of the sheet. Transports 20, 21, 22 advance the sheet along a path which produces an inversion thereof. However, inasmuch as the bottommost sheet is fed from duplex tray 32, the unprinted or clean side of the copy sheet is positioned in contact with the belt 6 at the transfer station D so that the toner powder image thereon is transferred thereto. The duplex sheets are then fed through the same path as the previously simplexed sheets to be stacked in tray 33 for subsequent removal by the printing machine operator.

A suitable machine clock pulse generator 50, which is drivingly coupled to the output shaft of a main drive motor 52, generates a succession of clock pulses whenever drive motor 52 is energized. The motor 52 may be connected to each of the transports 20, 21, 22, 23, 24, 47 and the drive for the belt 6 by way of suitable gear means to insure coordinated sheet movement and copy processing. As will be understood, to enhance copy throughput, several copy sheets may be in process at various locations along the paper path at any one time. To accommodate this and permit individual copies to be tracked and processed in the particular manner desired, timing control over the copy processing functions is divided into pitches, each pitch being further subdivided into a number of machine clock pulses. For example, the paper path may be separated into eleven pitches, one pitch for each copy sheet, with each pitch being composed of approximately 850 machine clock pulses.

Pitch reset signals, which serve in effect to determine the length of the pitch and the number of machine clock pulses within the pitch, are derived from copy sheet registration finger 53. For this purpose, a switch 54 is disposed adjacent registration finger 53. As a result, each revolution of finger 53 trips switch 54 to output a reset pulse. The output of machine clock pulses by generator 50 are input through the central processing master for the machine processing control while the pitch reset signals generated by switch 54 are input directly to a paper handling logic system.

To enable the user or operator of reproduction machine 5 to control the machine and program the copy run desired, a suitable operator control panel 60 is provided at some convenient location on machine 5. The copy run instructions programmed by control panel 60 are input to the central processing master where a copy information byte for each copy to be made is generated. Further descriptions of the control system for the machine 5 is not necessary for understanding and utilizing the present invention. A complete description of the control system is found in U.S. patent application Ser. No. 444634 (11-26-82) filed concurrently herewith by the common assignee and which is incorporated by reference.

Figure 2:
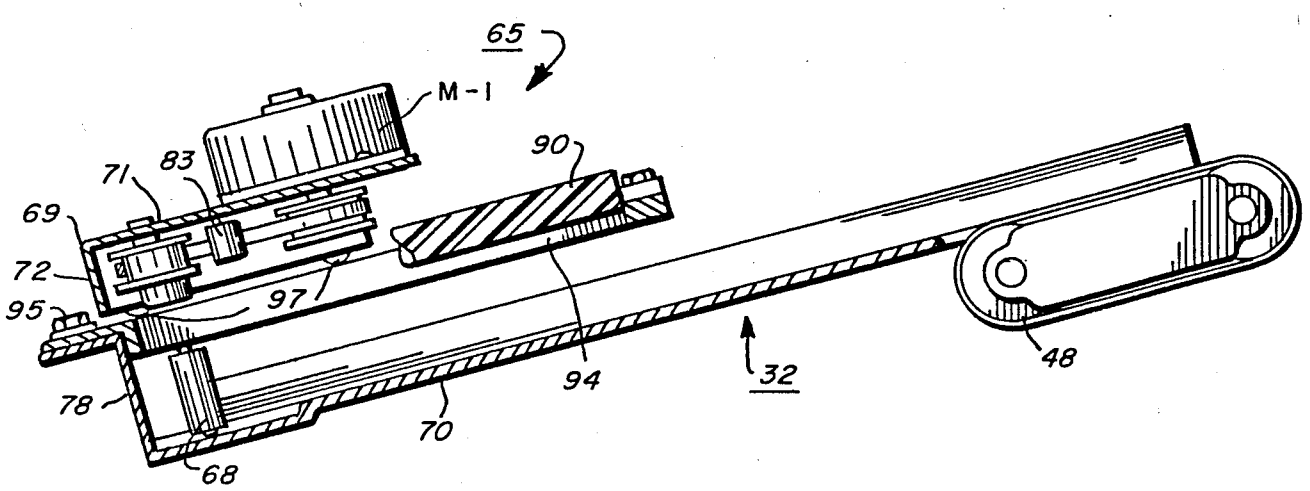
FIG. 2 is a fragmentary elevational view of the duplex tray shown in the machine of FIG. 1 incorporating the present invention.

Referring particularly to FIG. 2 of the drawings, the duplex tray 32 includes an adjustable copy sheet scuffer or back stop mechanism 65 for engaging the leading edge of the copy sheets to be duplexed as the copy sheets are fed into duplex tray 32 by the inverter transport 47 when reproduction machine 5 is programmed to produce duplex or two sided copies. The scuffer mechanism 65 serves to brake copy sheet movement and locate and settle the copy sheets into the duplex tray 32 in proper disposition for proper refeeding by duplex sheet feeder 48.

In the present invention, the scuffer mechanism 65 utilizes a pair of rotatable back stop rollers 67, 68 depending from a movable carriage assembly 69 mounted above the rear side of the tray 32 and at an angle perpendicular to the bottom plate 70 of the tray which supports copy sheets fed into and out of the tray. The back stop rollers 67, 68 are movable toward and away from the bottom feeder 48 as will be described hereinafter in order to position the leading edges of copy sheets in the tray so that they may be properly fed out of the tray by the feeder 48 during a duplex operation. This movement of the back stop rollers is devised to be in accordance with the various types of sheet widths that may be usable in the machine 5 especially in view of the numerous types of sheets which may be utilized as copy sheets in reproduction runs.

The adjustable range of movement for the rollers 67, 68 is approximately three inches in order to permit the accommodation of the international sheet sizes designated as B4 to B5. B5 sheets are nominally 71.7 inches in width which is equivalent to are nominally 10.12" or 257 mm. Within this range and contemplated by the present invention are the positioning of the rollers for standard U.S. sheet sizes, that is 8½" or 216 mm. Another international sheet size is designated as A4 paper having a width of 210 mm. The present arrangement is capable of handling sheet widths as previously stated from 182 mm to 257 mm. It will be understood that other sizes and ranges of paper widths and corresponding range of movements placed upon the rollers 67, 68 may be provided.

As shown in FIG. 2, a plurality of copy sheets are positioned in the tray 32 with their rear edges against the rollers 67, 68 and with their leading edges adjacent the bottom feeder 48 positioned to be fed from the tray. In entering the tray, what was once the leading edge of the sheets are now the trailing edges and what was the trailing edges are now the leading edges. The carriage assembly 69 upon which the depending back stop rollers 67, 68 are supported for rotation comprises a housing having an upper plate 71, a rear plate 72, and side plates 73, 74 and a bottom plate 75.

Figure 4:
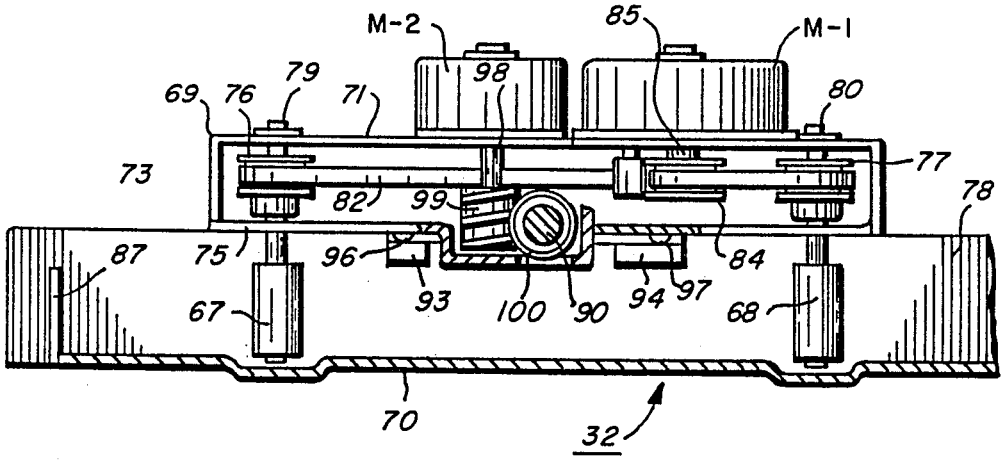
FIG. 4 is a fragmentary view showing the copy sheet scuffer assembly in more detail.

Within the housing of the assembly 69, a pair of pulleys 76, 77 are mounted for rotation between the plates 71, 75, and have their axis of rotation equally spaced from the rear wall 78 of the duplex tray 32. The pulleys 77, 78 are secured to the shafts 79, 80, respectively and are mounted for rotation through the plates 71, 75, being prevented from axial movement relative thereto by suitable lock washers. As shown in FIG. 4, the back stop roller 67 is mounted on the shaft 79 while the back stop roller 68 is mounted on the lower end of the shaft 80. With this arrangement, the axis of rotation of the rollers 67, 68 are parallel to each other and to the rear side 78 of the tray 32.

Figure 3:
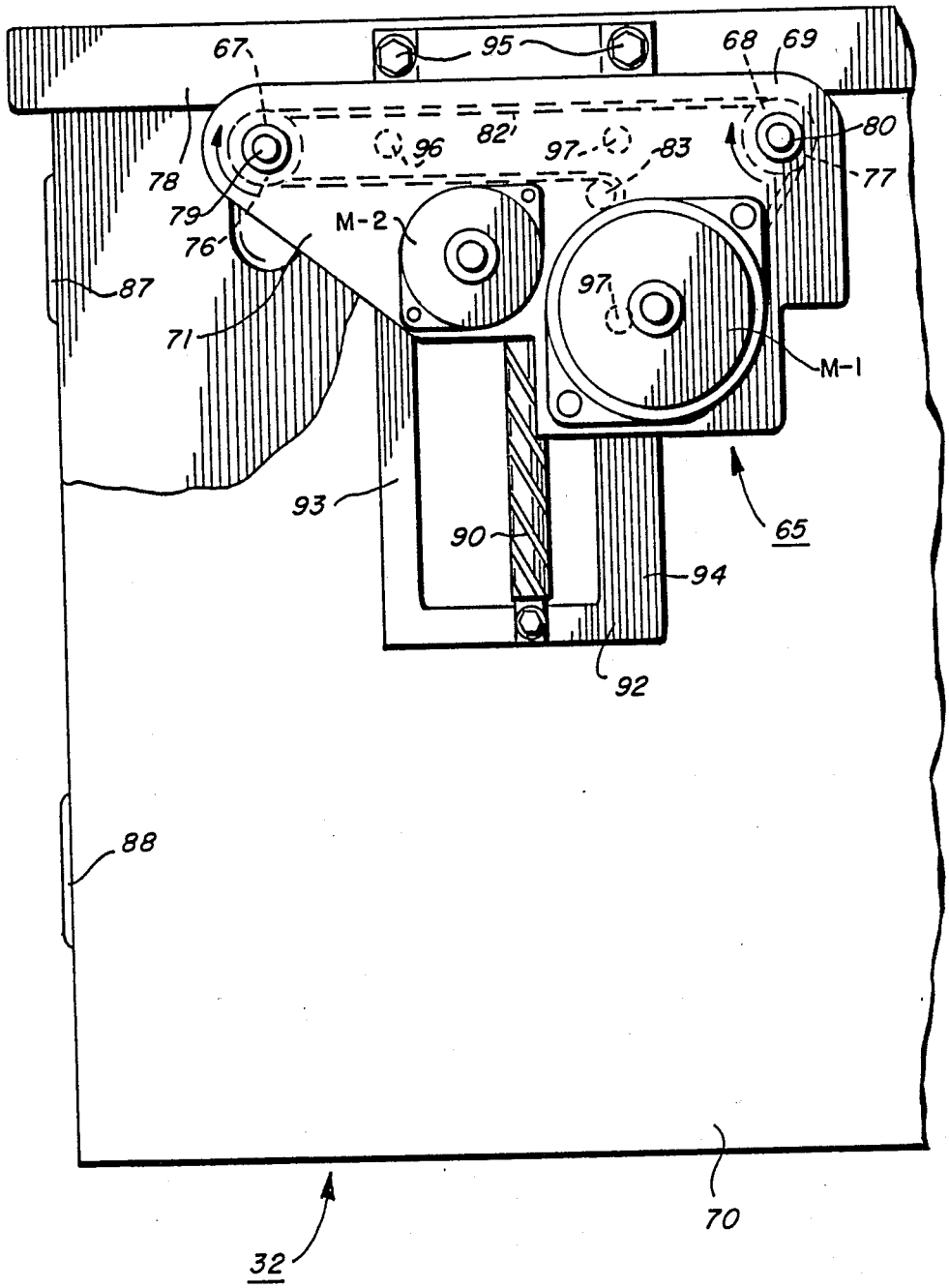
FIG. 3 is a fragmentary plan view of the duplex tray.

A timing belt 82 is entrained around the pulleys 76, 78, this belt also extending around an idler roller 83 mounted for rotation within the housing 69 and a drive pulley 84 secured to a shaft 85 for a reversible motor M-1 mounted upon the upper side of the top plate 71. As shown in FIG. 3, the belt 82 is arranged to impart rotation to the rollers 76, 78 in the same direction clockwise as shown in the drawing thereby forcing or scuffing each sheet of paper entering the tray against side registration stops 87, 88 mounted on the side edge of the bottom plate 70 for the tray 32. By this arrangement the scuffer mechanism 65 is adapted to register sheets in the forward direction and also to produce side registration so that copy sheets leaving the duplex tray for the duplex operation are properly corner registered as they leave the tray.

The scuffer housing 69 is movable toward and away from the feeder 48 in order to adjust the positioning of the back stop rollers 67, 68 relative to the feeder by means of a helical screw 90 mounted in fixed position with its axis in alignment with the direction of adjustable movement of the back stop rollers and along which the assembly 69 is moved in forward or reverse direction relative to the screw 90. The screw 90 is mounted at one end to a rectangular shaped frame member 92 having first and second longitudinal rail 93, 94 spaced parallel from each other and which are secured to the rear wall 78 of the duplex tray 32 by suitable screws 95. The scuffer housing 69 is arranged above the rails 93, 94 and are provided on the lower surface of the plate 75 with a dimple 96 depending therefrom and in engagement with the rail 93 and a pair of dimples 97 engageable with the second rail 94. The carriage 70 is adapted to be supported by and to slide upon the rails 93, 94 by virtue of the dimples 96, 97.

A reversible positioning motor M-2 is mounted on a top surface of the top plate 71 for the carriage 69 adjacent the motor M-1. The shaft 98 for the motor M-2 has a worm gear 99 secured at the end thereof positioned within the housing 69 and made drivingly cooperable with a nut 100 through which the fixed screw 90 is threaded. Upon energization of the motor M-2, the worm gear 99 produces rotation of the nut 100 and consequent movement of the nut, axially of the fixed screw 90. In this manner, the entire carriage 69 will be moved accordingly. The motor M-2 is of the reversible type so that energization may selectively effect movement of the carriage 69 in either direction, that is toward and away from the bottom feeder 48.

As previously stated, the present invention provides adjustment of back stop scuffer rollers 67, 68 for sheets in the duplex tray in accordance with width sizes of copy sheets placed in the machine 5 for duplex purposes. This adjustment may be made in accordance with known sheet sizes so that specific fixed adjustments can be made to the rollers 67, 68, or the back stop scuffer rollers may be positioned for any of a multiple or an infinite number of positioning placements. It is preferred that known fixed widths of copy sheets be utilized to control placement of the scuffer back stop rollers and that suitable mechanical adjustment means be incorporated in the sheet supply trays to accommodate changes in standard sheet sizes.

Energization of the positioning motor M-2 in either directional rotation to effect corresponding movement of the carriage 69 in either direction is under control of switches (not shown) placed relative to the sheet supply stacks 30, 31 and actuated by the width guide plates normally associated with such sheet supply trays. Copiers and duplicating machines in commercial use normally have copy sheet supply trays with adjustable width guide plates which the operator positions in accordance with the size of the copy sheets to be utilized in the copier/duplicator. With the use of adjustment positions, the guide plates are provided with fixed stops for ease of operation and control switches are associated with the width guide plates to effect energization of the positioning motor M-2 in accordance with the width dimension of the copy sheets.

As an example, if the B4 size paper is to be utilized, the width guide plates will be moved so as to provide 257 mm of space therebetween to accommodate the B4 size paper. When the width guide plates are so moved, a switch positioned in response thereto serves to produce energization of the positioning motor M-2 to drive the scuffer housing carriage 69 rearwardly to its rearwardmost position thereby placing the back stop scuffer rollers 67, 68 in position so that when the B4 size sheets are in the tray 32 the leading edges thereof are in position so as to be fed out of the tray by the feeder 48. As another example, the width guide plates for the trays 30, 31 may be moved closer together to accommodate B5 paper having a width of 182 mm. Another switch may be actuated with the width guide plates are moved to accommodate this size paper to actuate the positioning motor M-2 to a forward direction to bring the back stop rollers 67, 68 closer to the feeder 48.

With these extremes of paper widths and movement of the rollers 67, 68 relative to the feeder 48, any other size of sheets may be used between this range of movement of the back stop rollers and is available merely by utilizing additional switches in the paper supply trays 30, 31 to be actuated by the width guide plates which will be moved to accommodate any particular size paper.

Since the duplex tray 32 will only be used primarily for a duplex operation to produce copy sheets having information on both sides, it is envisioned that the energization of the positioning motor M-2 will occur only when the machine has been programmed for the duplex operation. This may be accomplished by a suitable button on the console 60 by a button labeled "Duplex" and which conditions the machine 5 for duplex operation. Actuation of this button is combined with the actuation of the switches associated with the sheet supply trays 30, 31 as aforesaid so that two inputs are necessary in order to accomplish energization in either direction of the positioning motor M-2, that is, duplex operation and copy sheet size. The actuation of the duplex button on the console 60 may also be utilized to effect rotation of the scuffer motor M-1 which is arranged to be continuously operating as long as the machine is conditioned for duplex operation and regardless of which size sheets are to be utilized in the duplex tray 32.

While the invention has been described with reference to the structure disclosed, it is not confined to the details set forth, but is intended to cover such modifications or changes as may come within the scope of the following claims.

I claim:

1. In a reproduction machine capable of duplex copying and including a sheet supply source and a duplex tray arranged for collecting copy sheets having an image on one side copied thereon, and means adjacent the duplex tray for feeding the copy sheets out of the duplex tray to receive a second image on the other side, the improvement including at least one back stop member positioned within the duplex tray being arranged to intercept copy sheets being collected therein and to arrest movement thereof, and means for moving said back stop member toward or away from the means for feeding the copy sheets out of the tray in accordance with a dimension of the copy sheets.

2. In a copier/duplicator capable of duplex copying and including a sheet supply source and a duplex tray arranged for collecting copy sheets having an image on one side copied thereon, and means adjacent the duplex tray for feeding the copy sheets out of the duplex tray to receive a second image on the other side, the improvement including at least one back stop member positioned within the duplex tray being arranged to intercept copy sheets being collected therein and to arrest movement thereof, and drive means connected to said back stop member for moving the same toward and away from this means for feeding the copy sheets out of the tray, and control means connected to said drive means for automatically activating the latter in accordance with a dimension of the copy sheets.

3. The copier/duplicator in claim 2 wherein said back stop member is rotatable and including means for rotating said member for effecting side ways movement of the sheets thereagainst.

4. In a reproduction machine capable of duplex copying and including a sheet supply source and a duplex tray arranged for collecting copy sheets having an image on one side copied thereon, and means adjacent the duplex tray for feeding the copy sheets out of the duplex tray to receive a second image on the other side, the improvement including a carrier mechanism positioned adjacent the duplex tray being arranged for movement toward and away from the means for feeding the copy sheets out of the tray, said mechanism having a back stop member to intercept copy sheets being collected in the duplex tray and to arrest movement thereof; and means for moving said carriage mechanism toward or away from the means for feeding the copy sheets out of the tray.

5. The machine in claim 4 wherein said means for moving said carriage mechanism includes a drive mounted on said mechanism.

* * * * *